United States Patent [19]

Komatsu et al.

[11] Patent Number: 4,678,397

[45] Date of Patent: Jul. 7, 1987

[54] VARIABLE-CAPACITANCE RADIAL TURBINE HAVING SWINGABLE TONGUE MEMBER

[75] Inventors: Hiroshi Komatsu, Yokosuka; Fumio Nishiguchi, Yokohama, both of Japan

[73] Assignee: Nissan Motor Co., Ltd., Yokohama, Japan

[21] Appl. No.: 619,481

[22] Filed: Jun. 11, 1984

[30] Foreign Application Priority Data

Jun. 15, 1983 [JP] Japan ..... 58-107248
Sep. 21, 1983 [JP] Japan ..... 58-172995
Sep. 21, 1983 [JP] Japan ..... 58-145082[U]

[51] Int. Cl.[4] ..... F01B 25/02

[52] U.S. Cl. ..... 415/151; 415/163; 415/205

[58] Field of Search ..... 415/151, 163, 164, 150, 415/205

[56] References Cited

U.S. PATENT DOCUMENTS 1,548,341 8/1925 Banki ..... 415/151
2,715,814 8/1955 Barr ..... 415/163
3,313,518 4/1967 Nancarrow .

FOREIGN PATENT DOCUMENTS 208316 3/1960 Austria ..... 415/163
2813638 11/1978 Fed. Rep. of Germany ..... 415/151
3219250 1/1983 Fed. Rep. of Germany .
10117 1/1983 Japan ..... 415/151
5484123 7/1984 Japan .
2100359 8/1984 United Kingdom .

*Primary Examiner*—Carlton R. Croyle
*Assistant Examiner*—Donald E. Stout
*Attorney, Agent, or Firm*—Schwartz, Jeffery, Schwaab, Mack, Blumenthal & Evans

[57] ABSTRACT

A variable-capacitance radial turbine has a swingable tongue member which is swingably mounted in an inlet throat portion of a scroll fluid passage of the turbine and which is swingable on a pivot shaft parallel to the turbine wheel axis. The right and left scroll side walls are formed with right and left seat surfaces, and the tongue member is formed with right and left sealing surfaces on both sides. The right and left seat surfaces and sealing surfaces are not perpendicular to the turbine wheel axis, and they are so shaped that when the tongue member is in a predetermined limit position, the right and left sealing surfaces are in contact with the right and left seat surfaces respectively so as to seal the clearances between the tongue member and the scroll side walls over the full length of the tongue member.

24 Claims, 18 Drawing Figures

VARIABLE-CAPACITANCE RADIAL TURBINE HAVING SWINGABLE TONGUE MEMBER

BACKGROUND OF THE INVENTION

The present invention relates to a variable-capacitance radial turbine having a swingable tongue member for varying a sectional area of an upstream throat portion of a turbine scroll fluid passage.

In general, an operating characteristic of an internal combustion engine equipped with a turbocharger is approximately determined by a ratio of an area A of the section of the turbine scroll throat portion, to a distance R between the turbine wheel axis and the center of gravity of the section of the scroll throat portion. A turbine having the ratio A/R of a high value is suitable for increasing the engine torque at high engine speeds.

A variable-capacitance radial turbine of a type to which the present invention relates, has a swingable tongue member which is arranged to change the sectional area A of the turbine scroll throat portion, and thereby provide an adequate supercharging not only at high engine speeds but also at low engine speeds. One example of such a variable-capacitance radial turbine is disclosed in Japanese Patent provisional publication No. 54-84123.

However, the swingable tongue member and the turbine scroll throat portion receiving the tongue member are liable to disturb the exhaust gas flow in the turbine scroll passage and reduce the turbine efficiency. Especially, the clearances which are formed between the tongue member and the scroll side walls in order to allow thermal expansion of the tongue member having a thermal expansion coefficient different from that of the turbine housing, are undesirable to the turbine efficiency. When the tongue member is in an outer limit position to minimize the sectional area A of the turbine scroll throat portion, the exhaust gases pass through these clearances from the upstream side to the downstream side in such a manner as to bypass the scroll passage, and flow into the normal exhaust gas flow coming through the scroll passage, so that the throttling effect of the tongue member is reduced, and the fluid energy is lost uselessly. When the tongue member is in an inner limit position to maximize the sectional area of the scroll throat portion, the exhaust gases pass through these clearances radially outwardly from the downstream side into the upstream throat portion, and this exhaust gas flow reduces the effect of the wide open tongue member and disturbs the fluid flow in the throat portion.

SUMMARY OF THE INVENTION

It is an object of the present invention to provide variable-capacitance radial turbines having scroll walls and a tongue member which are so designed as to improve the turbine efficiency by preventing undesirable fluid flows around the tongue member.

According to the present invention, a variable-capacitance radial turbine comprises a turbine wheel, housing means for enclosing the turbine wheel and a swingable tongue member. The housing means has a wheel chamber enclosing the turbine wheel, a scroll fluid passage which extends from an upstream throat portion to a downstream end portion circumferentially around the turbine wheel and has an aperture for directing a fluid from the scroll passage to the periphery of the turbine wheel in the wheel chamber, a fluid inlet passage for introducing the fluid into the scroll passage, and a fluid outlet for discharging the fluid from the wheel chamber. The scroll passage is bounded radially by a scroll outer peripheral wall facing toward the axis of the turbine wheel. The scroll passage is bounded axially by right and left scroll side walls which are axially spaced from each other and confront each other. Each of the scroll side walls is formed with a seat surface. The tongue member is swingably supported on the housing means for varying a sectional area of the throat portion of the scroll passage. The tongue member has two sealing surfaces which are in contact with the seat surfaces of the scroll side walls, respectively, when the tongue member is in a predetermined position.

Preferably, the seat surfaces of the scroll side walls are so arranged as to limit the swing motion of the tongue member by abutting on the sealing surfaced of the tongue member, respectively, when the tongue member is swung to the predetermined position. The tongue member has a swingable tip end and a base end portion having therein a pivot axis about which the tongue member can swing. The pivot axis of the tongue member is substantially parallel to the turbine wheel axis, and the tip end is swingable toward and away from the turbine wheel axis. The tongue member extends longitudinally from the base end portion to the tip end along the scroll passage in a direction of a normal fluid flow in the scroll passage. The sealing surfaces extend substantially over the full longitudinal length of the tongue member, and the seat surfaces extend longitudinally of the scroll passage in the same manner. Each of the sealing surface is in contact with the mating seat surface in such a manner that the area of contact therebetween has a width and a length which is substantially equal to the longitudinal length of the tongue member when the tongue member is in the predetermined position.

DETAILED DESCRIPTION OF THE INVENTION

Figure 1:
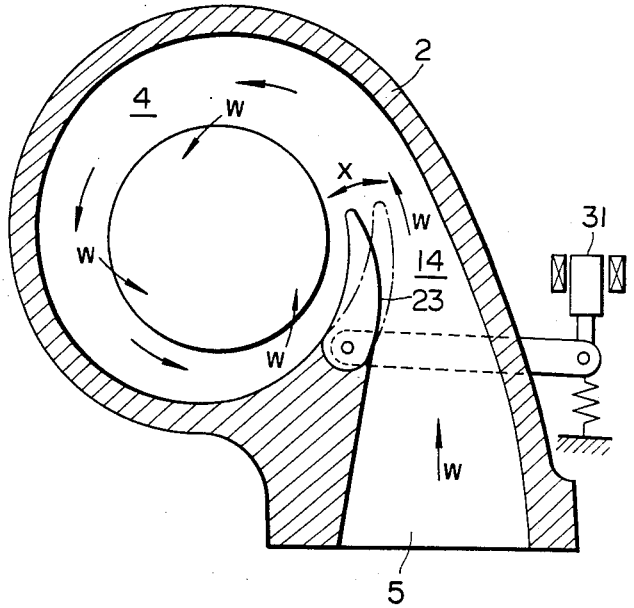
FIG.1 PRIOR ART
FIG. 1 is a schematic sectional view of a variable-capacitance radial turbine of a type having a swingable tongue member.

FIG. 1 shows a prior art variable-capacitance radial turbine of a type having a swingable tongue member 23.

Figure 2:
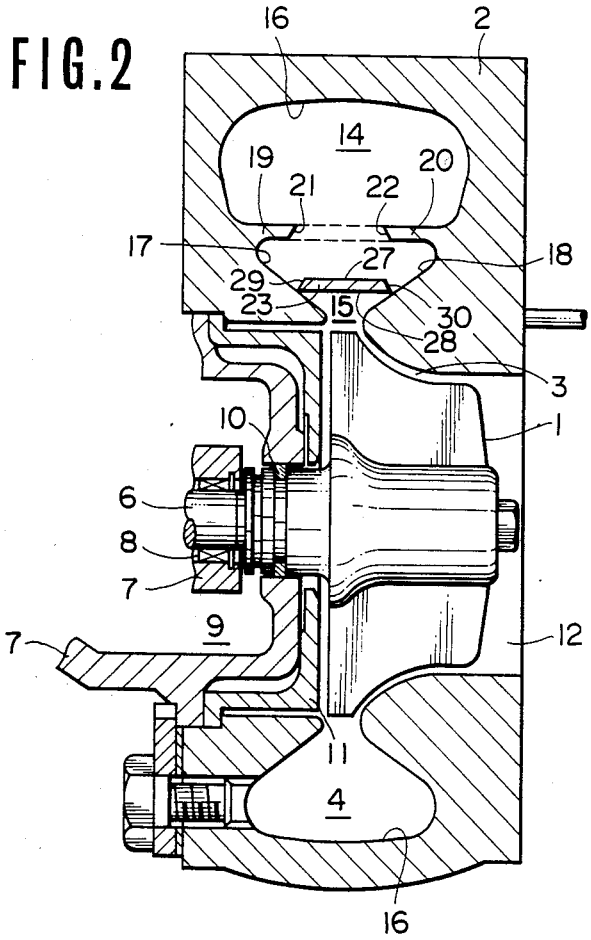
FIG. 2 is a sectional view of a variable-capacitance radial turbine of a first embodiment of the present invention.
Figure 3:
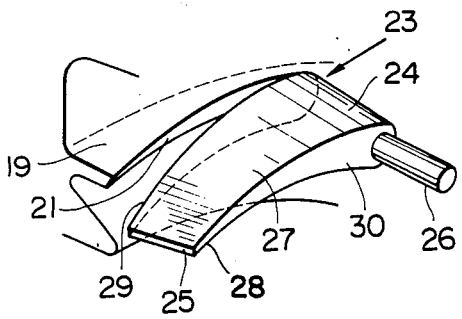
FIGS. 3 and 4 are schematic perspective views for showing the tongue member of the first embodiment in different positions.
Figure 4:
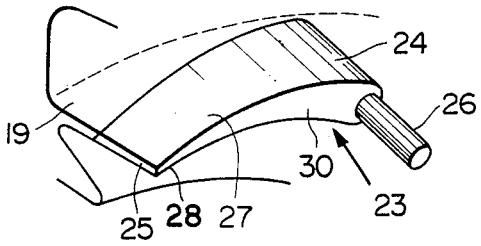

A first embodiment of the present invention is shown in FIGS. 2, 3 and 4. A variable-capacitance radial turbine of the first embodiment is a component of a turbocharger for an internal combustion engine. As shown in FIG. 2, a turbine wheel 1 is enclosed in a turbine housing 2. The turbine housing 2 is formed with a wheel chamber 3 for receiving the turbine wheel 1, and a scroll fluid passage 4 which surrounds the turbine wheel 1. The turbine housing 2 is further formed with an inlet fluid passage 5 (not shown in FIG. 2). The inlet fluid passage 5 is connected with an exhaust manifold of the associated engine, and introduces the exhaust gases of the engine to the scroll passage 4. The scroll passage 4 has a narrow aperture in the inner periphery. The exhaust gases in the scroll passage 4 can flow into the wheel chamber 3 toward the periphery of the turbine wheel 1 through the aperture of the scroll passage 4.

The turbine wheel 1 is mounted on a wheel shaft 6, and connected with a compressor wheel of the turbocharger (not shown) by the wheel shaft 6 for driving the compressor wheel. A center housing 7 supports the wheel shaft 6 rotatably through bearings 8. The center housing 7 is formed with an oil passage 9 for conveying an oil for cooling the bearings 8 and the wheel shaft 6. A ring seal 10 is disposed between the wheel shaft 6 and the center housing 7. The compressor side (the left-hand side as viewed in FIG. 2) of the wheel chamber 3 is closed by an annular shroud 11 and the center housing 7. The opposite side (the right-hand side as viewed in FIG. 2) of the wheel chamber 3 has a fluid outlet port 12 for discharging the exhaust gases out of the wheel chamber 3. The outlet port 12 is connected with an exhaust pipe (not shown).

The scroll passage 4 extends circumferentially around the turbine wheel 1 from an upstream throat portion 14 to a downstream end portion 15. The scroll passage 4 is bounded radially by an outer peripheral wall 16 facing toward the axis of the turbine wheel 1, and axially by left and right side walls 17 and 18 which are spaced axially of the turbine wheel 1 and confront each other. The section of the scroll passage 4 of the first embodiment, obtained if cut through by a plane containing the axis of the turbine wheel 1, has a shape which resembles a fan or sector and becomes narrower toward the axis of the turbine wheel 1. That is, the right and left side walls 18 and 17 are inclined to opposite sides with respect to an imaginary plane which lies between the right and left side walls and is perpendicular to the axis of the turbine wheel 1, and the axial distance between the right and left side walls 18 and 17 becomes smaller toward the axis of the turbine wheel 1. The sectorial sectional contour of the scroll passage 4 extends continuously and smoothly through the full longitudinal length of the scroll passage 4. Especially, there is no abrupt change of the sectorial sectional contour of the scroll passage 4 in the upstream throat portion 14 and the upstream and downstream sides of the throat portion 14. The sectorial contour of the scroll passage 4 extends continuously and smoothly from the upstream side of the throat portion 14 to the downstream side of the throat portion 14.

In the throat portion 14, the left and right scroll side walls 17 and 18 are, respectively, formed with shelves 19 and 20 of a plate shape, which project axially from the left and right side walls 17 and 18, respectively, toward each other. The shelves 19 and 20 project, respectively, from the side walls 17 and 18 at a predetermined radius position from the axis of the turbine wheel 1, and extend substantially horizontally as viewed in FIG. 2. Each of the shelves 19 and 20 has an outer surface facing radially outwardly, an inner surface facing toward the axis of the turbine wheel 1, and an end surface 21 or 22. The end surfaces 21 and 22 confront each other, but they are tapered in such a manner that the end surfaces 21 and 22 become gradualy wider apart toward the axis of the turbine wheel 1. That is, the end surfaces 21 and 22 are inclined to opposite sides with respect to an imaginary plane which lies between the end surfaces 21 and 22 and is perpendicular to the axis of the turbine wheel 1, and the axial distance between the end surfaces 21 and 22 becomes gradually greater toward the axis of the turbine wheel 1.

A tongue member 23 of a plate shape is disposed in the throat portion 14 of the scroll passage 4. The tongue member 23 extends longitudinally from a base end portion 24 to a tip end 25, in the fluid flow direction, as shown in FIGS. 3 and 4. The base end portion 24 has a pivot shaft 26, which is rotatably supported on the turbine housing 2, so that the tongue member 23 is swingable about an axis of the pivot shaft 26. The pivot shaft 26 is substantially parallel to the turbine wheel axis, and the tip end 25 swings toward and away from the turbine wheel axis. The tongue member 23 has an outer surface 27 facing radially outwardly, an inner surface 28 facing toward the turbine wheel axis, and two opposite side surfaces 29 and 30. The outer and inner surfaces 27 and 28 are curved longitudinally, and the longitudinal section of the tongue member 23 resembles a wing section, as shown in FIGS. 3 and 4. In the first embodiment, the two side surfaces 29 and 30 of the tongue member 23 are tapered in the same manner as the end surfaces 21 and 22 of the shelves 19 and 20, and the cross section of the tongue member 23 is approximately in a shape of an isosceles trapezoid having two parallel sides and two equal nonparallel sides, as shown in FIG. 2.

When the tongue member 23 is in an outer limit position shown by broken lines in FIG. 2 and in FIG. 4, the tongue member 23 is fitted between the shelves 19 and 20. In this outer limit position, the side surfaces 29 and 30 of the tongue member 23 are in contact with the end surfaces 21 and 22 of the shelves 19 and 20, respectively. On either side of the tongue member 23, the area of contact between the tongue member 23 and the shelf 19 or 20 extends substantially through the full longitudinal length of the tongue member 23 from the base end 24 to the tip end 25. The outer surface 27 of the tongue member 23 in the outer limit position forms a smooth and continuous surface with the outer surfaces of the shelves 19 and 20. The swing motion of the tongue member 23 in the radial outward direction is limited by the end surfaces 21 and 22 of the shelves.

The tongue member 23 is linked with an actuator 31 (not shown in FIG. 2). The swing motion of the tongue member 23 is controlled with the actuator. For example, the tongue member 23 is swung between an inner limit position shown by a solid line in FIG. 2 and in FIG. 3 and the above-mentioned outer limit position, in accordance with the rpm of the associated engine. The sectional area of the throat portion 14 through which the exhaust gases are allowed to enter the scroll passage 4 is smallest when the tongue member 23 is in the outer limit position, and largest when the tongue member 23 is in the inner limit position.

In this turbine, the exhaust gases of the engine flow into the scroll passage 4 through the throat portion 14, drive the turbine wheel 1 to rotate, and then flow from the turbine to the exhaust pipe. The velocity of the exhaust gases in the scroll passage 4 is proportional to the reciprocal of the radius from the axis of the turbine wheel 1. When the engine speed is high, the tongue member 23 is put in the inner limit position shown in FIG. 3, and thereby ensures a high flow rate of the exhaust gases by making the sectional area of the throat portion 14 large. When the engine speed is low, the tongue member 23 is put in the outer limit position shown in FIG. 4, so that the sectional area of the throat portion 14 is decreased, and the fluid velocity of the exhaust gases is increased. When the tongue member 23 is in the outer limit position, the inner surface of the tongue member 23 and the scroll side walls 17 and 18 form a sectorial sectional shape at the downstream end portion 15 of the scroll passage 4 inside the tongue member 23, so that there is no discontinuity in sectional shape of the scroll passage 4. This continuous sectorial shape formed at the downstream end portion 15 when the tongue member 23 is in the outer limit position can significantly reduce the frictional loss of the energy of the exhaust gases. In the turbine of the first embodiment, the sectional shape of the scroll passage 4 is sectorial throughout the full longitudinal length of the scroll passage 4, so that the fluid flow is not disturbed abruptly and a secondary flow, if any, is too weak to exert an undesirable influence on the main exhaust gas flow. The tongue member 23 when in the inner limit position is put in tight contact with the scroll side walls 17 and 18, so that the tongue member 23 in the inner limit position does not disturb the fluid flow.

In the variable-capacitance radial turbine of the first embodiment, the turbine efficiency can be improved, and the supercharge pressure can be increased without increasing the back pressure of the engine, so that the engine torque can be increased significantly.

Figure 5A:
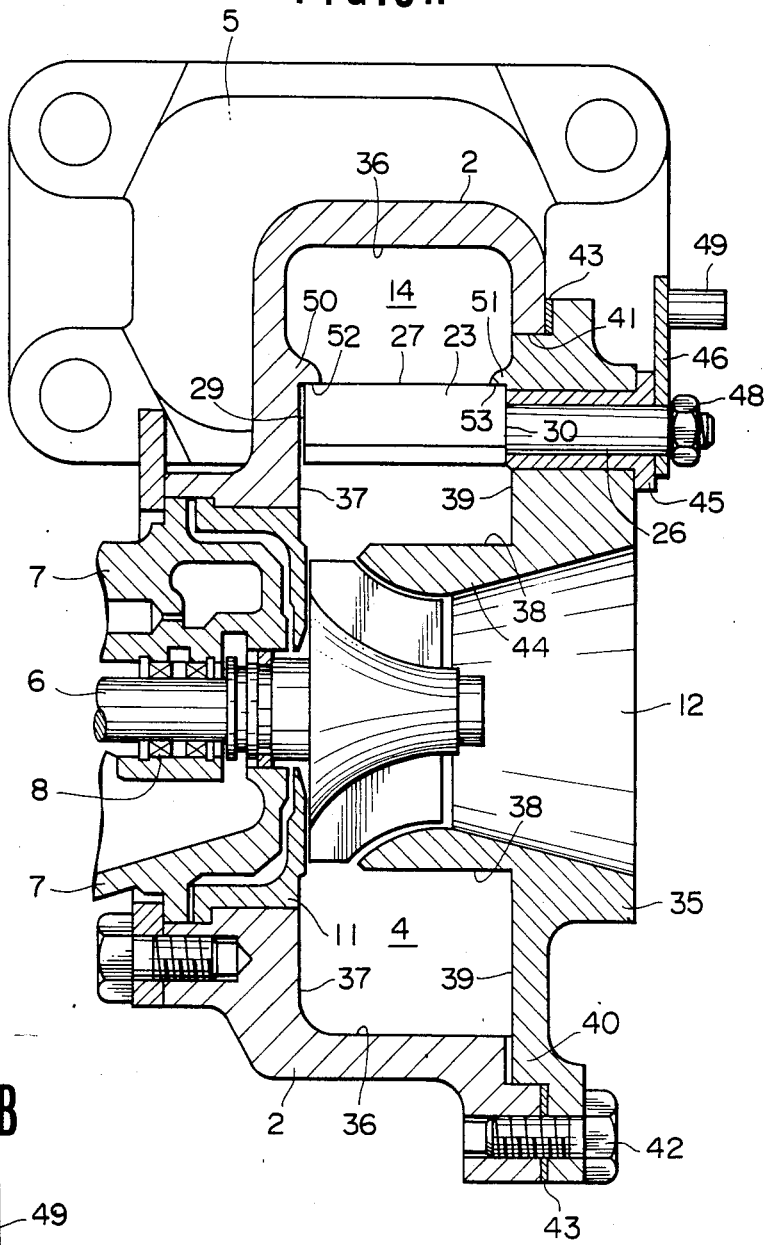
FIG. 5A is a sectional view of a variable-capacitance radial turbine of a second embodiment.

A second embodiment of the present invention is shown in FIGS. 5A, 5B, 6 and 7. The second embodiment is different from the first embodiment in the following points. In the second embodiment, the section of the scroll passage 4 is approximately rectangular. The turbine of the second embodiment has a turbine housing cover 35. The turbine housing 2 of the second embodiment is formed with an outer peripheral wall surface 36 and a left scroll side wall surface 37 which is flat and perpendicular to the turbine wheel axis. The turbine housing cover 35 is formed with an inner peripheral wall surface 38 and a right scroll side wall surface 39 which is flat and perpendicular to the turbine wheel axis. The scroll passage 4 is formed by the side wall surfaces 37 and 39, and the outer and inner peripheral wall surfaces 36 and 38. In a section obtained if cut through by a plane containing the turbine wheel axis, the outer and inner peripheral wall surfaces 36 and 38 are two straight lines parallel to the turbine wheel axis, as shown in FIG. 5A.

The housing cover 35 has a cylindrical portion 40, and the turbine housing 2 has a circular opening 41 on the righthand side as viewed in FIG. 5A. The cylindrical portion 40 of the cover 35 is fitted in the circular opening 41 of the turbine housing 2 from the right-hand side, and the cover 35 and the turbine housing 2 are fixed together by bolts 42 with the interposition of a packing 43. The turbine housing 35 has a shroud portion 44 extending axially toward the left-hand compressor side. The shroud portion 44 separates the wheel chamber 3 and the scroll passage 4, and has the scroll inner peripheral wall surface 38 and a wheel chamber wall surface closely facing the brades of the turbine wheel 1. The fluid outlet port 12 for discharging the exhaust gases from the wheel chamber 3 is formed in the turbine housing cover 35.

The side surfaces 29 and 30 of the tongue member 23 are not tapered, but they are substantially perpendicular to the turbine wheel axis and the pivot shaft 26 of the tongue member 23. Accordingly, the left side surface 29 of the tongue member 23 and the left scroll side wall surface 37 are parallel to and confront each other, and similarly the right side surface 30 and the right scroll side wall surface 39 are parallel to and confront each other. The side surfaces 29 and 30 are finished finely and accurately by machining. The scroll side wall surfaces 37 and 39 are also finished smoothly.

Figure 5B:
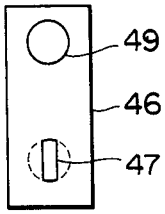
FIG. 5B is a plan view of an arm plate of FIG. 5A.

The pivot shaft 26 fixed to the tongue member 23 is rotatably supported by a bushing 45 which is forcibly fitted into a hole of the housing cover 35. A rectangular arm plate 46 shown in FIG. 5B is fixed to an outside end of the pivot shaft 26 of the tongue member 23. In this example, the arm plate 46 is formed with a non-circular hole 47. The pivot shaft 26 has a threaded portion whose cross sectional shape corresponds to the non-circular hole 47. The threaded portion of the pivot shaft 26 is inserted through the non-circular hole 47 of the arm plate 46. The pivot shaft 26 and the arm plate 46 are fastened by a nut 48. The arm plate 46 is connected with the actuator 31 (not shown in FIG. 5A) through a connecting pin 49. This link arrangement between the pivot shaft 26 of the tongue member 23 and the actuator 31 is also applicable to the first embodiment.

Figure 6:
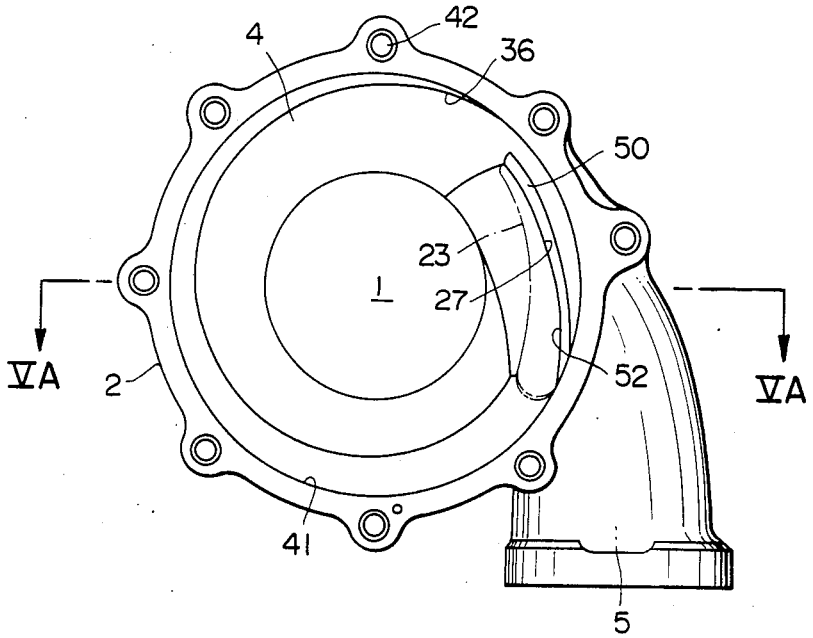
FIG. 6 is a front view of a turbine housing of the second embodiment.
Figure 7:
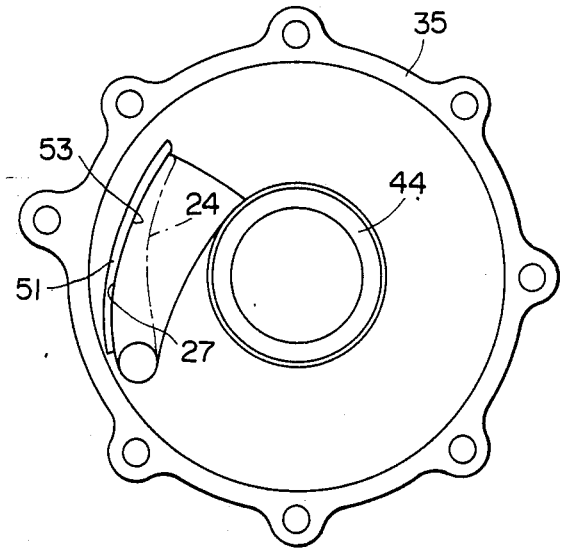
FIG. 7 is a front view of a turbine housing cover of the second embodiment.

Projections 50 and 51 are formed in the confronting scroll side walls, respectively. The projections 50 and 51 project, respectively, from the scroll side wall surface 37 of the turbine housing 2 and the scroll side wall surface 39 of the turbine housing cover 35. Thus, the projections 50 and 51 project axially toward each other. Each of the projections 50 and 51 has an inner surface 52 or 53 facing toward the turbine wheel axis. The inner surfaces 52 and 53 are so shaped that they are in contact with the left and right margins of the outer surface 27 of the tongue member 23, respectively, when the tongue member 23 is in the outer limit position shown in FIG. 5A. As in the first embodiment, the area of contact extends substantially through the full longitudinal length of the tongue member 23 on either side of the tongue member 23. As shown in FIGS. 6 and 7, the inner surfaces 52 and 53 of the projections 50 and 51 extend curvedly along the longitudinal direction of the scroll passage 4 from a position of the base end portion 24 of the tongue member 23 to a position of the tip end 25 of the tongue member 23 in the outer limit position. The curvature of the inner surfaces 52 and 53 of the projections 50 and 51 is the same as the curvature of the outer surface 27 of the tongue member 23.

Thus, the tongue member 23 can prevent the exhaust gases from passing through the clearances between the tongue member 23 and the scroll side walls when the tongue member 23 is in the outer limit position to make the sectional area of the throat portion 14 smallest. Therefore, the turbine efficiency in this state is significantly improved, as in the first embodiment.

Figure 8:
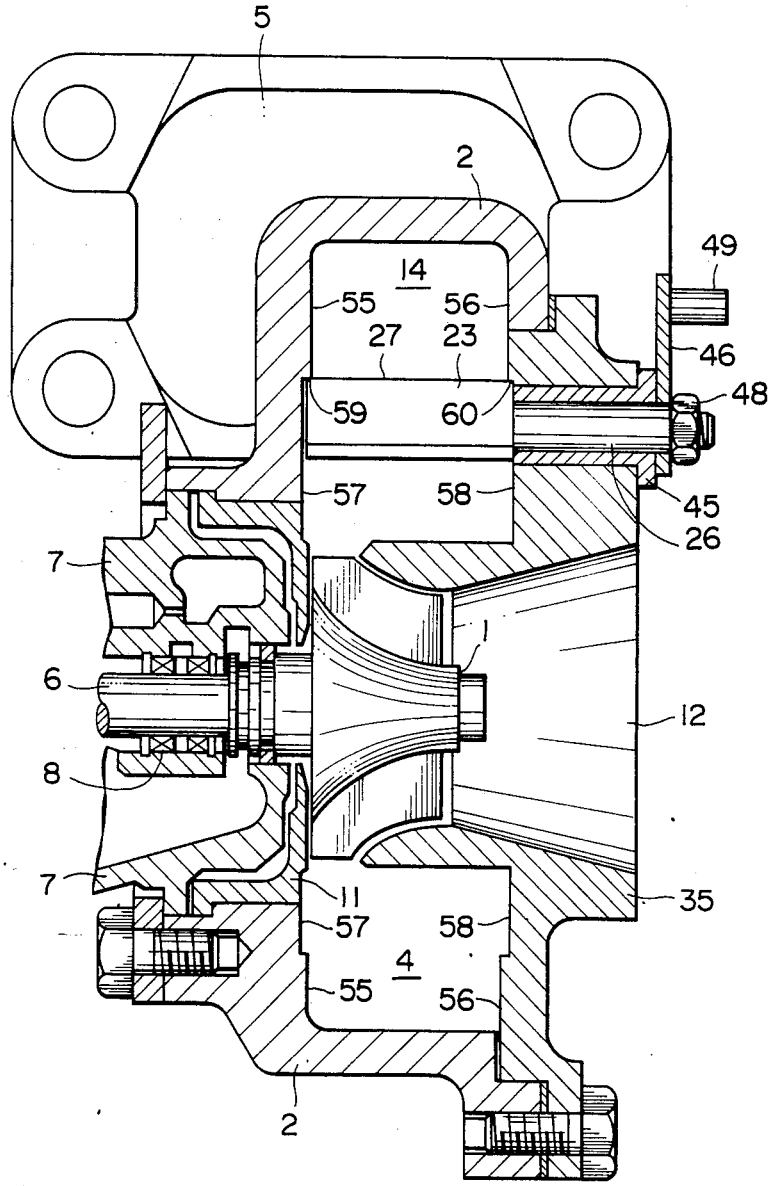
FIG. 8 is a sectional view of a variable-capacitance radial turbine of a third embodiment.
Figure 9:
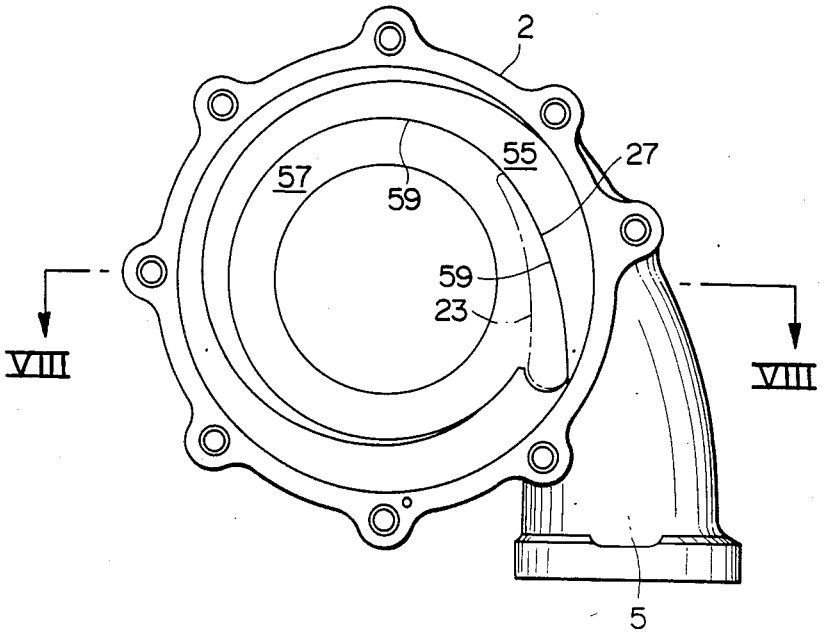
FIG. 9 is a front view of a turbine housing of the third embodiment.
Figure 10:
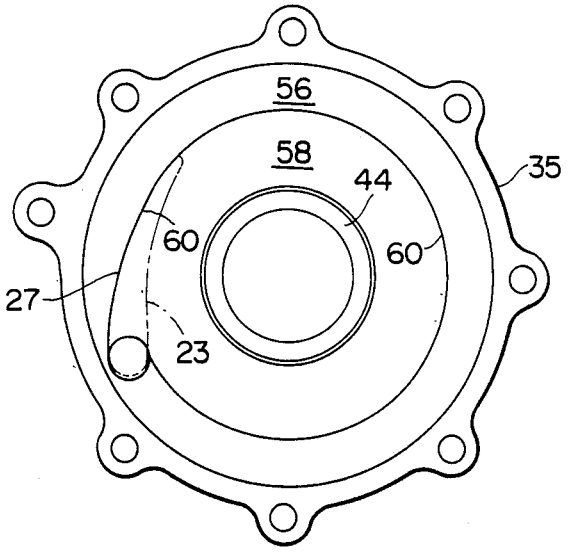
FIG. 10 is a front view of a turbine housing cover of the third embodiment.

A third embodiment of the present invention is shown in FIGS. 8, 9 and 10. In the third embodiment, the scroll passage 4 is substantially rectangular in section, and formed by the turbine housing 2 and the turbine housing cover 35 in the same manner as in the second embodiment. The third embodiment is different from the second embodiment in that each of the scroll side walls has a step or level difference which forms an inwardly facing wall surface for abutting on the outer surface 27 of the tongue member 23, and which extends circumferentially around the turbine wheel 1 through 360 degrees. This design facilitates the machining operation for the scroll side walls. Each of the scroll side walls of the third embodiment, therefore, has an outer side wall surface 55 or 56 and an inner side wall surface 57 or 58. The outer and inner wall surfaces of each side wall are both flat and perpendicular to the turbine wheel axis, but they are displaced axially relative to each other so that the inner surface is depressed and the outer surface is projected. In each side wall, the inwardly facing surface 59 or 60 is formed between the inner periphery of the outer surface and the outer periphery of the inner surface. Each of the inwardly facing surfaces 59 and 60 is approximately in a shape of a cylindrical surface which is coaxial with the turbine wheel 1, and narrow in axial dimension. A portion of each of the inwardly facing surfaces 59 and 60 is so shaped that it can receive the tongue member 23 and it can be in contact with the outer surface 27 of the tongue member 23 over the full longitudinal length of the tongue member 23 when the tongue member 23 is in the outer limit position, as shown in FIGS. 9 and 10. The side wall design of the third embodiment is advantageous in resistance to thermal stress cracking.

Figure 11:
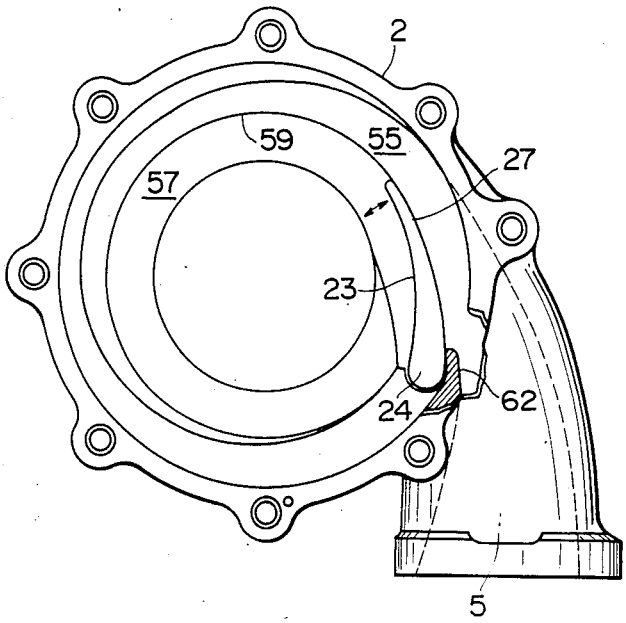
FIG. 11 is a front view of a variable-capacitance radial turbine of a fourth embodiment.

A fourth embodiment of the present invention is shown in FIG. 11. The fourth embodiment is different from the third embodiment in that the turbine housing 2 of the fourth embodiment is further formed with a stationary tongue portion 62 which overlaps the base portion 24 of the tongue member 23 from the outer side, in order to improve the sealing effectiveness around the base portion of the tongue member 23. An inner surface of the stationary tongue portion 62 is so shaped that it can be in contact with the outer surface 27 of the base portion of the tongue member 23 when the tongue member is in the outer limit position.

Figure 12:
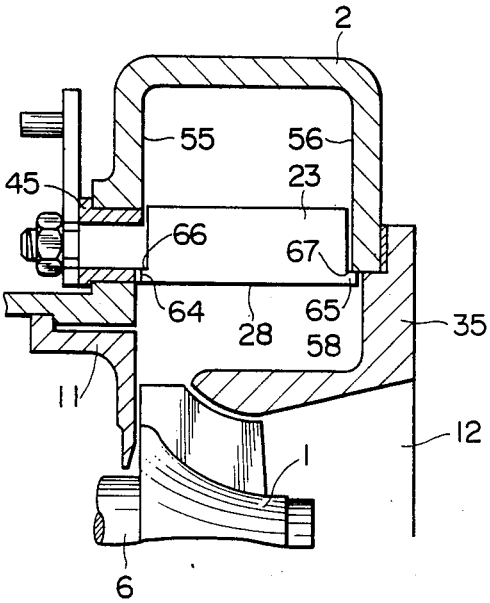
FIG. 12 is a sectional view of a portion of a variable-capacitance radial turbine of a fifth embodiment.
Figure 13:
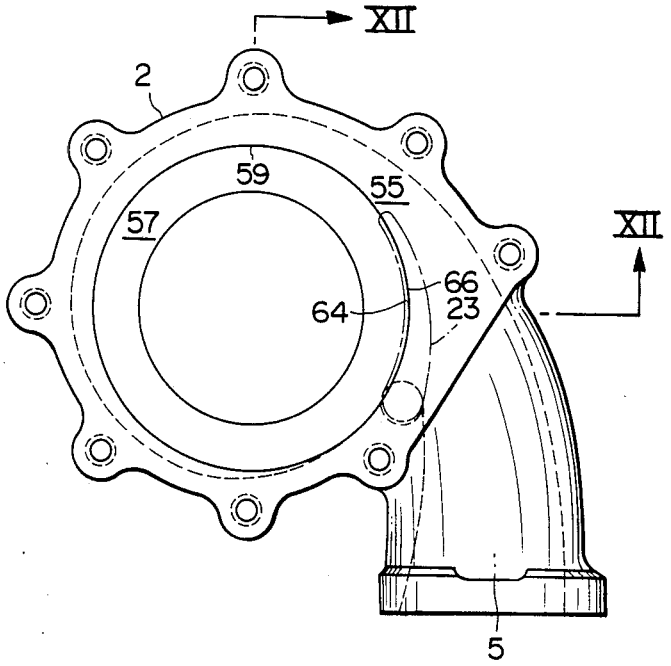
FIG. 13 is a front view of a turbine housing of the fifth embodiment.

A fifth embodiment is shown in FIGS. 12 and 13. In this embodiment, the tongue member 23 is formed with two flanged portions 64 and 65 projecting from the side surfaces 29 and 30, respectively. Each of the flanged portion 64 and 65 is rectangular in section, as shown in FIG. 12, and has an outer surface 66 and 67, an inner surface, and an end surface. The inner surface of each flanged portion 64 or 65 is continuous with the inner surface 28 of the tongue member 23. In the fifth embodiment, the inwardly facing shelf surfaces 59 and 60 are a right circular cylindrical surface coaxial with the turbine wheel, and accordingly the outer surfaces 66 and 67 of the flanged portions 64 and 65 are also cylindrical, as shown in FIG. 13. This design is advantageous for the machining process and assembly process for the turbine, and makes it possible to reduce the turbine size. When the tongue member 23 is in the outer limit position, the outer surfaces 66 and 67 of the flanged portion 64 and 65 of the tongue member 23 are in contact with the inwardly facing shelf surfaces 59 and 60 of the side walls over the full longitudinal length of the tongue member 23. In the fifth embodiment, the actuator 31 is disposed on the side of the turbine housing 2. The inwardly facing shelf surface 59 of the compressor side passes through the bushing 45 for the pivot shaft 26 of the tongue member 23. It is advisable to fit the bushing 45 forcibly into the hole of the turbine housing 2 first, and to cut the inwardly facing shelf surface 59 next. In the fifth embodiment, the shelf surface 60 of the left-hand fluid outlet side is formed in the turbine housing 2 as a part of the inwardly facing cylindrical wall end surface of the circular opening 41 in which the cylindrical portion 40 of the turbine housing cover 35 is fitted.

Figure 14:
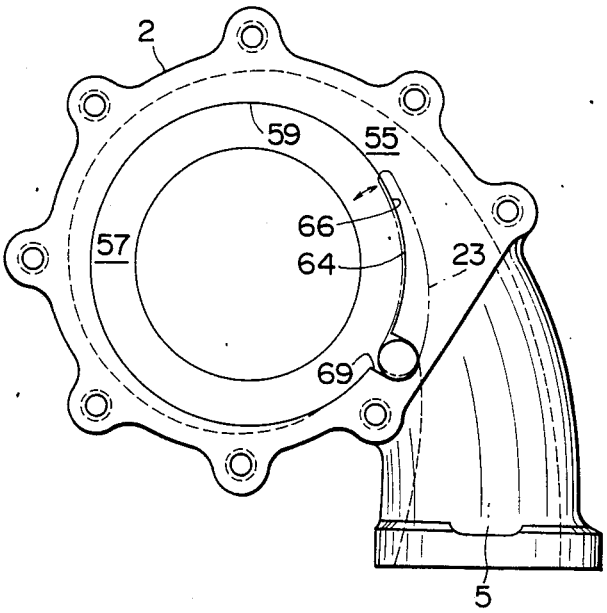
FIG. 14 is a front view of a modification of the turbine housing of FIG. 13.

FIG. 14 shows a modification of the turbine housing 2 of the fifth embodiment. In FIG. 14, the inwardly facing shelf surface 59 of the scroll side wall is formed with a recessed portion 69 for receiving the bushing 45 for the pivot shaft 26 of the tongue member 23. This design facilitates assembly of the bushing 45 and the tongue member 23, and eliminates the need of cutting the bushing 45.

Figure 15:
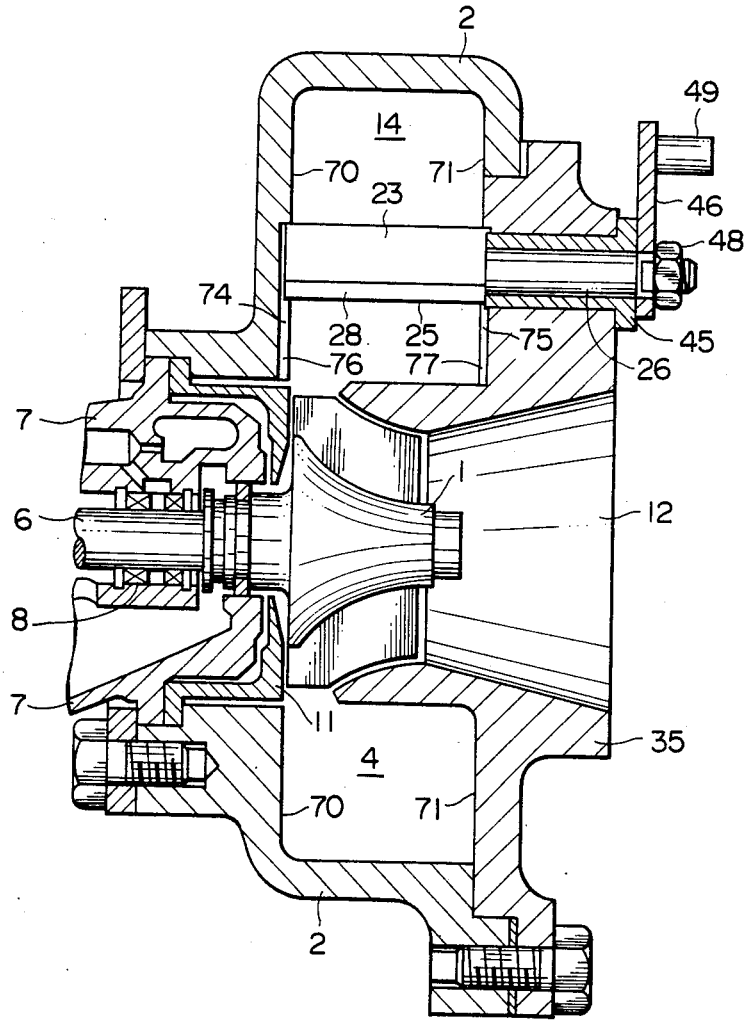
FIG. 15 is a sectional view of a variable-capacitance radial turbine of a sixth embodiment.
Figure 16:
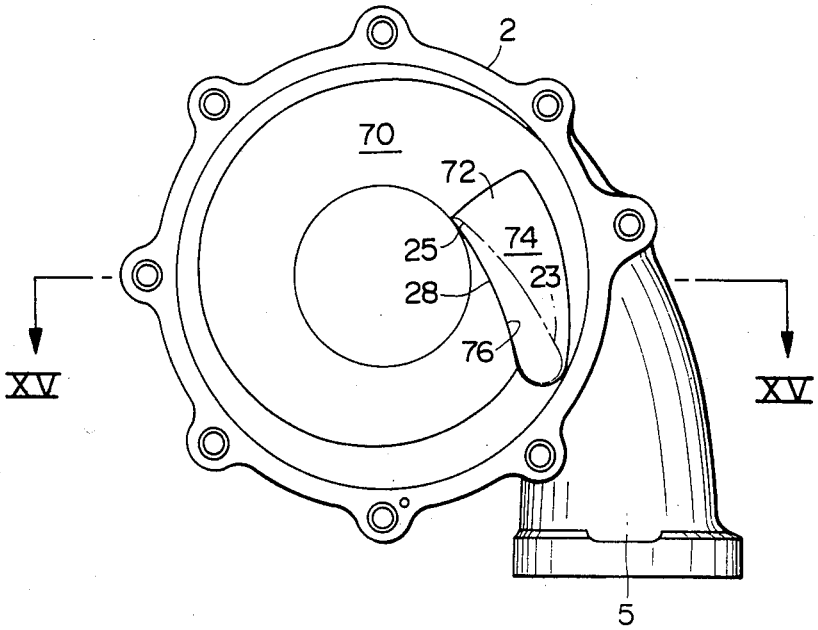
FIG. 16 is a front view of a turbine housing of the sixth embodiment.
Figure 17:
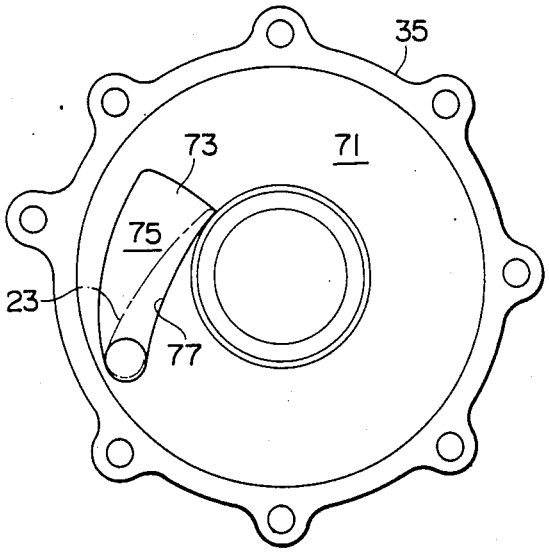
FIG. 17 is a front view of a turbine housing cover of the sixth embodiment.

A sixth embodiment of the present invention is shown in FIGS. 15, 16 and 17. In the sixth embodiment, the scroll passage 4 is substantially rectangular in section as in the third embodiment. Each of the scroll side walls of the sixth embodiment has a main flat side wall surface 70 or 71 and a depressed portion 72 or 73 which is so formed as to define the sweep or extent of the angular motion of the tongue member 23. Each of the depressed portion 72 and 73 is depressed blow the surrounding main side wall surface. Each of the depressed portions 72 and 73 has a radially outwardly facing narrow rim surface 76 or 77 which extends axially between the bottom 74 or 75 of the depressed portion and the main side wall surface 70 or 71. Each of the radially outwardly facing rim surfaces 76 and 77 is so shaped that it can be in contact with the inner surface 28 of the tongue member 23 over the full longitudinal length of the tongue member 23 when the tongue member 23 is in the inner limit position in which position the tip end 25 of the tongue member 23 is closest to the turbine wheel 1 and the sectional area of the throat portion 14 of the scroll passage 4 is maximized. That is, each of the radially outwardly facing rim surfaces 76 and 77 has a curvature equal to the curvature of the inner surface 28 of the tongue member 23, and a length enough to cover the full longitudinal length of the tongue member 23. This design of the sixth embodiment prevents the exhaust gases from passing from the scroll downstream end portion to the scroll upstream throat portion 14 through the clearances between the tongue member 23 and the scroll side walls when the tongue member 23 is in the inner limit position. Therefore, this design can avoid the fluid energy loss due to confluence of two fluid flows having different velocities and different directions, and thereby improve the turbine efficiency during the time that the throat portion is widely open, so that the back pressure of the engine can be decreased and the engine torque at high engine speeds can be significantly increased.

What is claimed is:

1. A variable-capacitance radial turbine comprising:

a turbine wheel, housing means having a wheel chamber enclosing said turbine, a scroll fluid passage which extends from an upstream throat portion to a downstream end portion circumferentially around said turbine wheel and has an aperture for directing a fluid from said scroll passage to the periphery of said turbine wheel in said wheel chamber, a fluid inlet passage for introducing the fluid into said scroll passage, and a fluid outlet for discharging the fluid from said wheel chamber, said scroll passage being bounded radially by a scroll outer peripheral wall facing toward the axis of said turbine wheel, said scroll passage being bounded axially by right and left scroll sidewalls which are axially spaced from each other and confront each other, each of said scroll sidewalls being formed with a seat surface, said seat surfaces of said scroll sidewalls limiting the swing motion of said tongue member by abutting, respectively, on said sealing surfaces of said tongue member when said tongue member is swung to said predetermined position, a tongue member swingably support on said housing means for varying a sectional area of said throat portion of said scroll passage, and having a width smaller than a distance between said right and left scroll sidewalls said tongue member having two sealing surfaces, said sealing surfaces of said tongue member being, respectively, in contact with said seat surfaces of said sidewalls when said tongue member is in a predetermined position, and;

a swingable tip end positioned on said tongue member and a base end portion having therein a pivot axis about which said tongue member can swing, said pivot axis being substantially parallel to the axis of said turbine wheel and said tip end being swingable toward and away from the axis of said turbine wheel, said tongue member longitudinally extending from said base end portion to said tip end along said scroll passage in a direction of a normal fluid flow in said scroll passage, said sealing surfaces extending substantially over the full longitudinal length of said tongue member on both sides of said tongue member, said seat surfaces extending longitudinally of said scroll passage, each of said sealing surfaces being in contact with the mating seat surface in such a manner that the area of contact therebetween has a width and a length which is substantially equal to the longitudinal length of said tongue member when said tongue member is in said predetermined position.

2. A turbine according to claim 1, wherein a section of said scroll passage obtained if cut through by an intersecting plane containing the axis of said turbine wheel has an approximately sectorial contour which becomes narrower toward the axis of said turbine wheel, each of said scroll side walls within said throat portion being formed with a shelf of a plate shape, said shelves of said scroll side walls projecting axially from said side walls, respectively, toward each other, said shelves having said seat surfaces, respectively, said tongue member being fitted between said shelves when said tongue member is in said predetermined position.

3. A turbine according to claim 2, wherein said shelves preventing said tip end of said tongue member from further swinging radially outwardly, and the sectional area of said throat portion is smallest when said tongue member is in said predetermined position.

4. A turbine according to claim 3, wherein said shelves extend longitudinally of said scroll passage through a length which is equal to or greater than the longitudinal length of said tongue member, said shelves having, respectively, end surfaces which are so tapered that the axial distance between said end surfaces becomes smaller radially outwardly, said tongue member having opposite side surfaces which are so tapered that the axial distance between said side surfaces of said tongue member becomes smaller radially outwardly, said seat surfaces being said end surfaces of said shelves and said sealing surfaces being said side surfaces of said tongue member.

5. A turbine according to claim 4, wherein said tongue member has an outer surface facing radially outwardly, and each of said shelves has an outer surface facing radially outwardly, said outer surfaces of said tongue member and said shelves being smoothly continuous when said tongue member is fitted between said shelves in said predetermined position.

6. A turbine according to claim 5, wherein the sectorial contour of said scroll passage becomes smaller smoothly and continuously from the upstream throat portion to the downstream end portion.

7. A turbine according to claim 1, wherein said sealing surfaces of said tongue member face radially outwardly, and said seat surfaces of said scroll side walls face toward the axis of said turbine wheel and prevent said tip end of said tongue member from further swinging radially outwardly by abutting on said sealing surfaces, the sectional area of said throat portion of said scroll passage being smallest when said tongue member is in said predetermined position.

8. A turbine according to claim 7, wherein each of said scroll side walls has a first flat side wall surface which is substantially perpendicular to the axis of said turbine wheel, and said tongue member swings between said first flat side wall surfaces.

9. A turbine according to claim 8, wherein each of said scroll side walls is formed with a projecting portion, said projecting portions projecting axially toward each other from said first flat side wall surfaces, respectively, each of said projecting portions having an inner surface facing toward the axis of said turbine wheel, said inner surfaces of said projecting portions extending circumferentially from said base end portion of said tongue member in said predetermined position to said tip end of said tongue member in said predetermined position, said seat surfaces being said inner surfaces of said projecting portions.

10. A turbine according to claim 9, wherein said tongue member has an outer surface facing radially outwardly, and said sealing surfaces are marginal portions of said outer surfaces of said tongue member.

11. A turbine according to claim 10, wherein said housing means comprises a turbine housing and a housing cover, said turbine housing having said scroll outer peripheral wall, said left scroll side wall and an inward flange portion which extends radially inwardly from said scroll outer peripheral wall so as to form a part of said right scroll side wall and has a cylindrical end surface defining a circular opening whose center lies on the axis of said turbine wheel, said housing cover having a cylindrical portion fitted in said circular opening of said turbine housing and an outward flange portion for fixing said housing cover to said turbine housing, said right scroll side wall being formed by said cylindrical portion of said housing cover and said inward flange portion of said turbine housing, said first flat side wall surface and said projecting portion of said right scroll side wall being formed in said cylindrical portion of said housing cover, said fluid outlet being formed in a central portion of said cylindrical portion of said housing cover.

12. A turbine according to claim 8, wherein each of said scroll side walls has a second flat side wall surface which is substantially perpendicular to the axis of said turbine wheel, said first flat side wall surface being axially depressed below said second flat side wall in each scroll side wall, each of said scroll side walls having at least one houndary surface which extends axially between said first and second flat side wall surfaces and faces toward the axis of said turbine wheel, said seat surfaces being said boundary surfaces.

13. A turbine according to claim 12, wherein said first and second flat side wall surfaces and said boundary surfaces extend circumferential around said turbine wheel through 360 degrees.

14. A turbine according to claim 13, wherein said tongue member has an outer surface facing radially outwardly, and said sealing surfaces are marginal portions of said outer surface of said tongue member.

15. A turbine according to claim 14, wherein said housing means has a stationary tongue portion which overlaps said outer surface of said base end portion of said tongue member, said stationary tongue member having an inner surface which faces toward the axis of said turbine wheel and is in contact with said outer surface of said base end portion of said tongue member when said tongue member is in said predetermined position.

16. A turbine according to claim 13, wherein said tongue member is formed with right and left flanged portions on both sides, each of said flanged portions having an outer surface facing radially outwardly, said sealing surfaces being said outer surfaces of said flanged portions.

17. A turbine according to claim 16, wherein said boundary surfaces are a right circular cylindrical surface.

18. A turbine according to claim 17, wherein said housing means comprises a turbine housing and a housing cover, said turbine housing having said scroll outer peripheral wall, said left scroll side wall and an inward flange portion which extends radially inwardly from said scroll outer peripheral wall so as to form a part of said right scroll side wall and has a cylindrical end surface defining a circular opening whose center lies on the axis of said turbine wheel, said housing cover having a cylindrical portion fitted in said circular opening of said turbine housing and an outward flange portion for fixing said housing cover to said turbine housing, said first flat wall surface of said right scroll side wall being formed in said cylindrical portion of said housing cover, said second flat side wall surface of said right scroll side wall being formed in said inward flange portion of said turbine housing, said boundary surface of said right scroll side wall being formed in said cylindrical end surface of said inward flange portion of said turbine housing.

19. A turbine according to claim 1, wherein said sealing surfaces of said tongue member face toward the axis of said turbine wheel, and said seat surfaces of said scroll side walls face radially outwardly and prevent said tip end of said tongue member from further swinging radially inwardly by abutting on said sealing surfaces, the sectional area of said throat portion of said scroll passage being largest when said tongue member is in said predetermined position.

20. A turbine according to claim 19, wherein each of said scroll side walls has a first flat side wall surface and a second flat side wall surface which are both substantially perpendicular to the axis of said turbine wheel, said first flat surface being axially depressed below said second surface in each of said side walls, each of said scroll side walls having at least one boundary surface extending axially between said first and second flat surfaces and facing radially outwardly, said seat surfaces being said boundary surfaces.

21. A turbine according to claim 20, wherein said tongue member has an inner surface facing toward the axis of said turbine wheel, said sealing surfaces being marginal portions of said inner surface of said tongue member.

22. A turbine according to claim 1, wherein said right and left scroll sidewalls are formed with right and left projections, respectively, projecting axially toward each other, said seat surfaces being formed in said right and left projections, respectively, said seat surfaces being non-parallel with a plane perpendicular to said pivot axis of said tongue member, and said seat surfaces being able to limit the swing motion of said tongue member when said tongue member is swung to said predetermined position.

23. A turbine according to claim 22, wherein said seat surfaces face in a substantially radial direction which is one of a direction radially inward toward the axis of said turbine wheel and a direction radially outward opposite to said radially inward direction.

24. A turbine according to claim 22, wherein said turbine is adapted to be driven by exhaust gases of an internal combustion engine.

* * * * *